US006398077B1

(12) United States Patent
Gross et al.

(10) Patent No.: US 6,398,077 B1
(45) **Date of Patent: *Jun. 4, 2002**

(54) PACKAGE WITH MULTIPLE CHAMBERS AND VALVES

(75) Inventors: Richard A. Gross, Oconomowoc; Daniel G. Schantz, Muskego, both of WI (US); Timothy R. Socier, Essexville, MI (US); Fred H. Martin, Racine; Julie M. Grissmeyer, Waterford, both of WI (US); Duncan Toll, Wilton, CT (US)

(73) Assignee: Seaquist Closures Foreign, Inc., Crystal Lake, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/502,630

(22) Filed: Feb. 11, 2000

(51) Int. Cl.[7] ..... B67D 3/60

(52) U.S. Cl. ..... 222/145.1; 222/145.5; 222/490; 222/521

(58) Field of Search ..... 222/94, 145.1, 222/145.5, 490, 494, 521

(56) References Cited

U.S. PATENT DOCUMENTS

| | | | | |
|---|---|---|---|---|
| 4,753,536 A | | 6/1988 | Spehar et al. | |
| 4,964,539 A | | 10/1990 | Mueller | |
| 5,102,016 A | | 4/1992 | Ball et al. | |
| 5,137,178 A | * | 8/1992 | Stokes et al. | 222/94 |
| 5,152,432 A | | 10/1992 | Laforcade | |
| 5,398,846 A | | 3/1995 | Corba et al. | |
| 5,611,463 A | | 3/1997 | Favre | |
| 5,615,803 A | | 4/1997 | Hatakeyama et al. | |
| 5,653,361 A | | 8/1997 | Favre | |
| 5,676,289 A | | 10/1997 | Gross et al. | |
| 5,680,969 A | | 10/1997 | Gross | |
| 5,833,121 A | | 11/1998 | Gueret | |
| 5,839,626 A | | 11/1998 | Gross et al. | |
| 5,873,494 A | | 2/1999 | Dallas, Jr. | |
| 5,938,086 A | | 8/1999 | Gross | |
| 5,954,213 A | | 9/1999 | Douglas et al. | |
| 6,065,642 A | * | 5/2000 | Brown | 222/494 |

FOREIGN PATENT DOCUMENTS

| | | |
|---|---|---|
| EP | 0 759 876 B1 | 3/1997 |

* cited by examiner

*Primary Examiner*—Kevin Shaver
*Assistant Examiner*—Thach H Bui
(74) *Attorney, Agent, or Firm*—Rockey, Milnamow & Katz, Ltd.

(57) ABSTRACT

A dispensing system is provided for two, constituent, fluent materials which are stored separately and then combined in a dispensing process to form a combination product. The dispensing system includes a container having at least two interior storage chambers, and each chamber has a separate discharge opening. Associated with each discharge opening is a separate, flexible valve. Each valve has an initially closed dispensing orifice which opens in response to a differential between the pressure acting against the side of the closed valve facing toward the associated discharge opening and the pressure acting against the side of the closed valve facing away from the associated discharge opening. In a preferred embodiment, a top is provided downstream of the valve. The top is movable between (1) a close position to occlude a dispensing flow path downstream of the valves, and (2) an open position which permits flow to be discharged from the system.

13 Claims, 13 Drawing Sheets

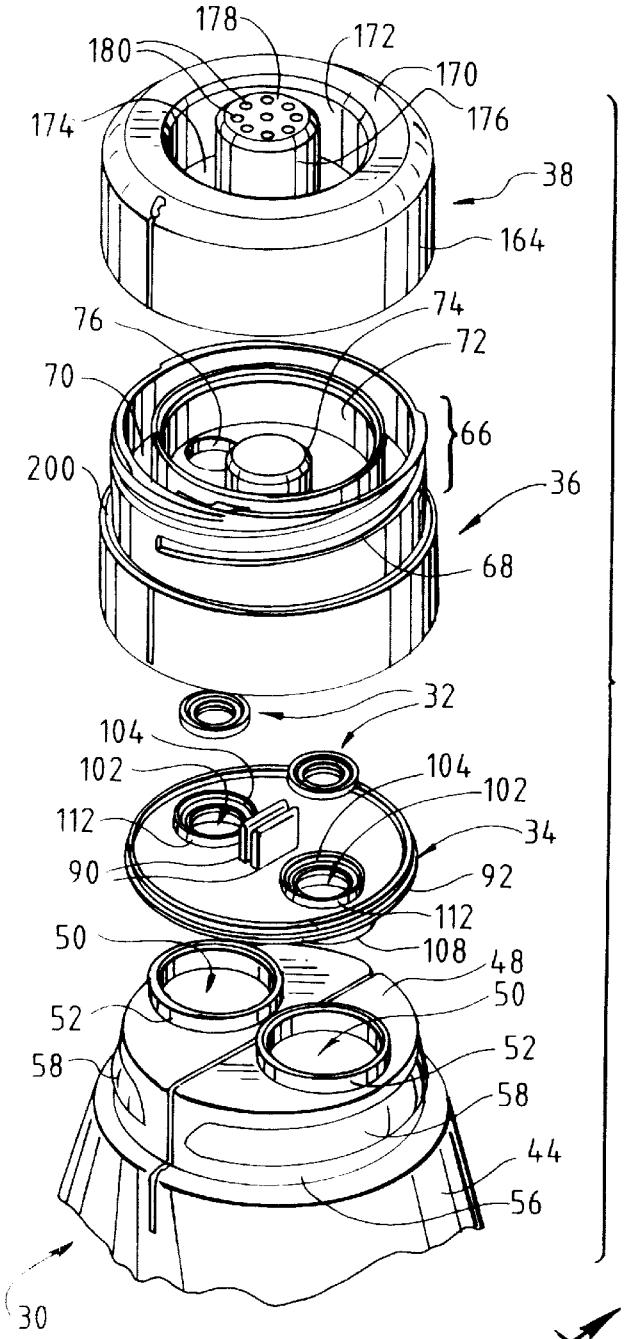
FIG. 2
FIG. 1
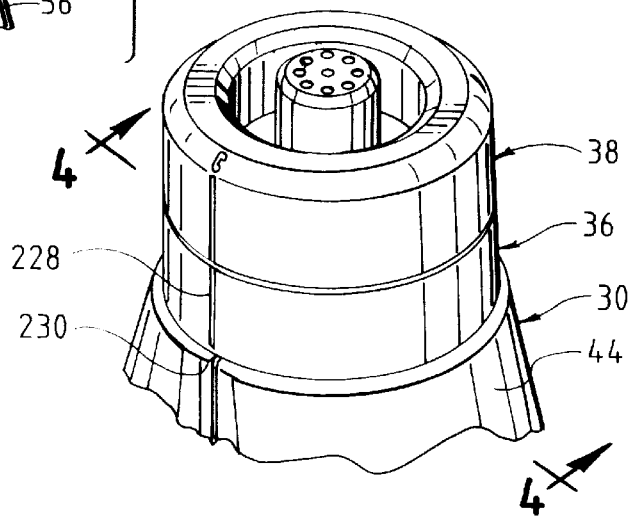

PACKAGE WITH MULTIPLE CHAMBERS AND VALVES

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to a system for dispensing a product from a container. This system is designed to permit the combination of two or more individual fluent constituents within the system and to dispense from the system a product which is made up of a combination of the constituents. The system is especially suitable for use in a flexible container which is squeezable.

BACKGROUND OF THE INVENTION AND TECHNICAL PROBLEMS POSED BY THE PRIOR ART

There are a wide variety of packages which include a (1) a container, (2) a dispensing discharge structure extending as a unitary part of, or as an attachment to, the container, and (3) a fluent product contained within the container. One type of such a package employs a single dispensing valve for discharging a single stream of a fluent product (which maybe a liquid, cream, or particulate product). See, for example, U.S. Pat. No. 5,409,144 which discloses a package that includes a flexible, resilient, slit-type valve at one end of a generally flexible bottle or container. The valve is normally closed and can withstand the weight of the product when the container is completely inverted, so that the product will not flow through the valve unless the container is squeezed.

Such a valve may also be employed within a closure behind (i.e., upstream of) a perforated baffle. Such a system works particularly well with fine powder. The powder can be squeezed through the valve and then through the baffle apertures in a dispersed discharge pattern or distribution pattern. See, for example, U.S. Pat. No. 5,676,289.

In some applications, it would be desirable to provide a package in which the two or more constituents could be separately stored prior to use and which could subsequently permit the dispensing of the constituents together as a combination product. The constituents might be materials that react with each other to form a product that requires substantially immediate use, and such materials should be kept from contacting each other during storage. Some conventional packages of this type rely on a physical barrier between internal dispensing passageways to separate the constituent materials. The barrier must be manipulated, and at least partially removed or breached, so as to permit the mixing of the constituents just prior to dispensing. It would be desirable to provide an improved system in which constituents could be maintained in separate storage compartments and could subsequently be combined without the need to remove a physical barrier.

It would also be desirable to provide means for sealing the system to prevent inadvertent discharge of the constituents during manufacturing, shipping, handling, etc. Such a system should be readily operable by the user and not interfere with combining the constituent materials when it is desired to dispense the constituent materials together as a combined product.

It would also be beneficial if such an improved system could be provided to accommodate the dispensing of the combined constituent materials as a fluent product through a structure that could be relatively readily manufactured and installed in the package.

Such an improved dispensing system should also preferably have the capability for facilitating dispensing of the constituent materials when the interior of the container is pressurized (e.g., when the container is squeezed or when the container's internal pressure is increased by other means).

It would also be advantageous if such an improved system could accommodate bottles, containers, or other packaging systems having a variety of shapes and that are constructed from a variety of materials.

Further, it would be desirable if such an improved system could accommodate efficient, high-quality, large-volume manufacturing techniques with a reduced product reject rate to produce a system with consistent operating characteristics.

The present invention provides an improved system which can accommodate designs having the above-discussed benefits and features.

BRIEF SUMMARY OF THE INVENTION

The present invention provides a system for dispensing a product, formed as a combination of two or more constituent materials, from a package. The system can accommodate the discharge of fluent materials such as liquids, creams, or particulate matter, including powders.

The system advantageously functions to store the plurality of constituent materials as separate quantities which are not combined during storage. During use, only the amounts of constituent materials that are to be dispensed are combined during the dispensing process.

Further, in a preferred formed of the invention, an apertured baffle structure is provided at the end of the package for effecting a desired dispersion or distribution pattern of the product that is formed from the combination of the separate constituents.

Additionally, in a preferred form of the invention, a positive closure seal is provided in the system for preventing any flow out of the package unless and until the closure seal is manually manipulated to an open condition.

The dispensing system includes a container having at least two interior storage chambers. Each storage chamber is adapted to hold a different fluent constituent or material. Each storage chamber includes an associated, separate discharge opening.

Associated with each discharge opening is a separate flexible valve. There is a separate valve for each discharge opening. Each valve is sealingly disposed over its associated discharge opening.

Each valve has an initially closed dispensing orifice which opens in response to a differential between the pressure acting against the side of closed valve facing toward the associated discharge opening and the pressure acting against the side of the closed valve facing away from the associated discharge opening.

The valves are preferably identical and typically open substantially simultaneously if the pressure is increased in both storage chambers substantially simultaneously. The material or constituent in each storage chamber is forced through the valve associated with each storage chamber and combines with the other material or constituent in a region downstream of the valves.

In a preferred embodiment, the region downstream of the valves is covered by a top which defines an interior dispensing flow path. The top includes an occlusion member which (1) occludes the dispensing flow path when the top is in a closed position, and (2) opens the dispensing flow path when the top is moved away from the closed position. Preferably, the top also defines a dispersion baffle having apertures at the end of the dispensing flow path to effect the dispersion of the fluent product discharging from the system.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same, FIG. 1 is a fragmentary, perspective view of a first embodiment of the dispensing system of the present invention;

FIG. 2 is a fragmentary, exploded, perspective view of the first embodiment of the dispensing system shown in FIG. 1;

FIG. 8 is a view similar to FIG. 5, but FIG. 8 shows the system in an open condition, whereas FIGS. 1—7 show the system in a closed condition;

DESCRIPTION OF THE PREFERRED EMBODIMENTS

Figure 3:
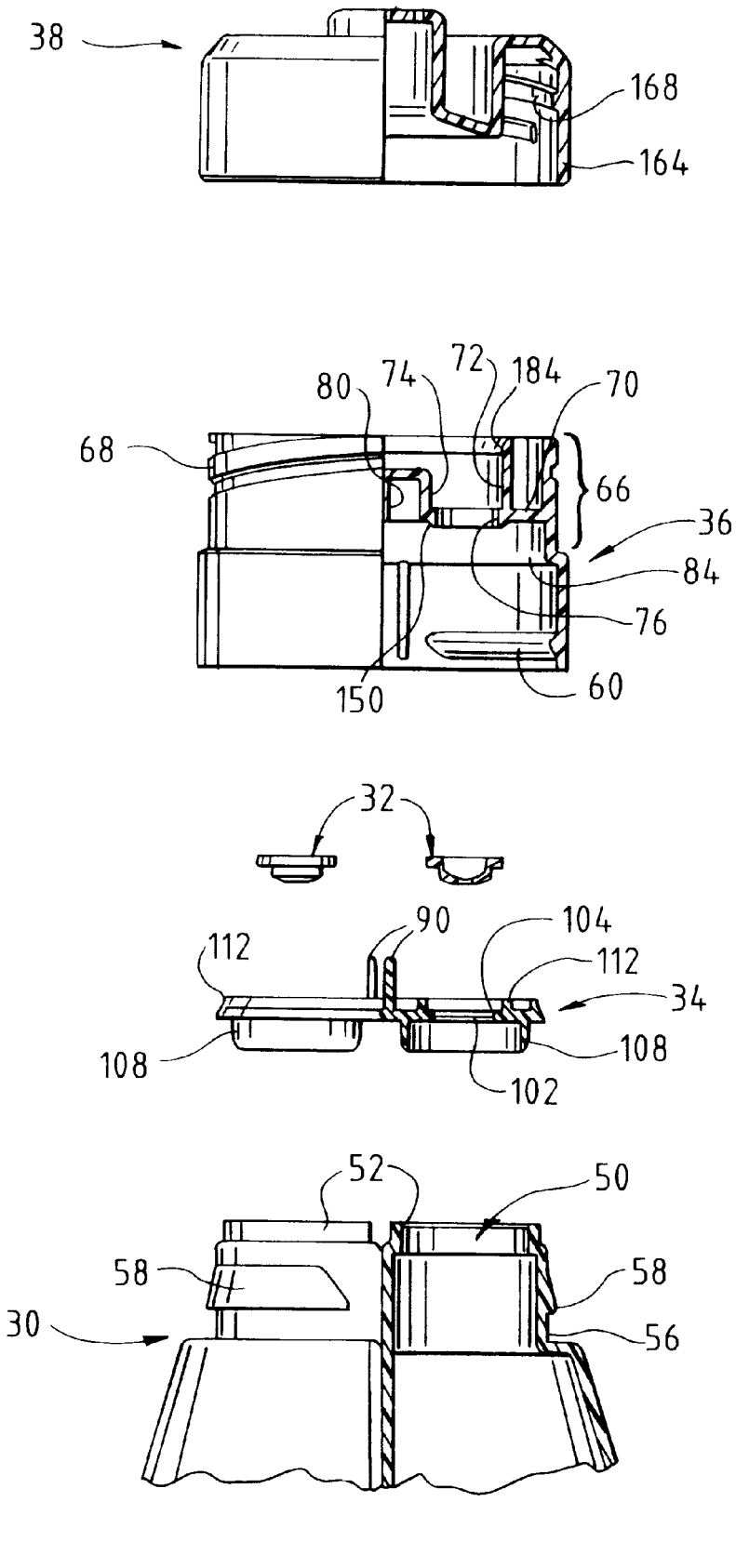
FIG. 3 is an exploded, side elevational view, partially in cross section, of the components of the first embodiment of the dispensing system of the present invention shown in FIGS. 1 and 2.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

The first embodiment of the dispensing system of the present invention is illustrated in FIGS. 1–13 in the form of a package comprising a container 30, two slit valves 32, a valve holder plate 34, a closure body 36, and a closure top 38.

Figure 6:
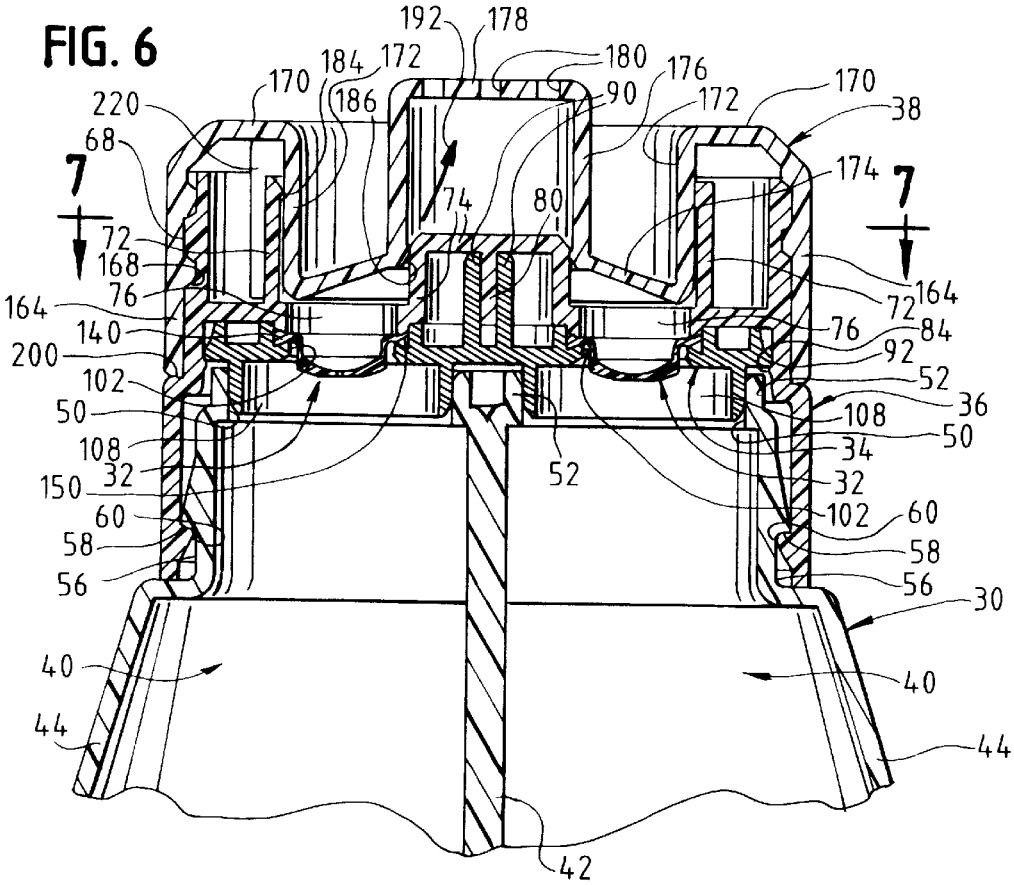
FIG. 6 is a fragmentary, cross-sectional view taken generally along the plane 6—6 in FIG. 5.

As shown is FIG. 6, the container 30 includes two storage chambers 40 divided by a central wall 42. Each storage chamber 40 is defined in part by the intermediate dividing wall 42, and also in part by an exterior wall 44 which defines a major, exterior portion of the container 30.

As can be seen in FIG. 2, the container 30 includes a closed, upper end wall or deck 48 which defines two discharge openings 50. The container 30 has separate collars 52 each projecting upwardly from the deck 48 around a discharge opening 50.

The upper end of the container 30 below the end wall or deck 48 defines a reduced diameter, generally cylindrical wall 56 from which project two oppositely directed retention beads 58 (FIG. 2).

The container 30 may have more than two storage chambers 40 (FIG. 6), each with an associated discharge opening 50 (FIG. 2) and valve 32. In such a structure with more than two storage chambers, there would necessarily be a plurality of dividing wall structures on the interior of the container 30. The other components, such as the valve holder plate and the closure body, would be configured as necessary to accommodate three or more storage chambers and valves.

The storage chambers 40 (FIG. 6) are adapted to each contain a separate constituent or material that is to be combined with the other constituent or constituents during the dispensing process. However, during the storage process, when the package is not being used to dispense a product, the constituents are maintained separately within their respective storage chambers.

It is contemplated that each material or constituent is the type of substance which, when mixed with the other constituent or constituents, reacts to form a combination product that is best used relatively quickly (e.g., a foaming cleaning product). Each constituent could be a fluent product, such as a liquid, gaseous material, or particulate matter, including powder or the like. The constituents could be components of a comestible product, personal care product, industrial or household cleaning product, or other chemical composition (e.g., compositions for use in activities involving manufacturing, commercial or household maintenance, construction, agriculture, etc.).

The container 30 can be a squeezable container having a flexible wall or walls 44 which can be grasped by the user and squeezed or compressed to increase the internal pressure within the container 30 so as to force the constituents out of the container storage chambers 40 and through the dispensing system structures at the top of the container 30 as described in detail hereinafter.

The exterior container wall 44 typically has sufficient, inherent resiliency so that when the squeezing forces are removed, the container wall 44 returns to its normal, unstressed shape. Such a squeezable wall structure is preferred in many applications but may not be necessary or preferred in other applications. For example, in some applications it may be desirable to employ a generally rigid container and to instead pressurize the interior storage chambers 40 at selected times with pistons or other pressurizing systems (not illustrated).

The closure body 36 is adapted to be mounted to and retained on, the upper end of the container 30. Specifically, the lower portion of the closure body 36 is adapted to be received on the cylindrical wall 56 at the upper end of the container 30. As shown in FIGS. 3 and 6, the closure body 36 includes a pair of inwardly extending ribs 60 which each engage the bottom surface of the adjacent container bead 58 (FIG. 6). The closure body 36 is preferably molded from a thermoplastic material, such as polyethylene or polypropylene, and has sufficient resiliency to accommodate the forcing of the closure body 36 onto the container cylindrical portion 56 so that the closure body ribs 60 are temporarily deflected outwardly over the container beads 58 until the closure body ribs 60 pass below the container beads 58 and snap back inwardly into engagement underneath the container beads 58 owing to the inherent resiliency of the thermoplastic material from which the closure body 36 is molded. To accommodate this snap-fit type mounting engagement, the upper surface of the container bead 58 has a generally tapered configuration which increases in width with increasing distance from the upper end of the container 30. In analogous fashion, the lower surface of each closure body rib 60 extends further inwardly with increasing distance upwardly from the lower end of the closure body 36.

As can be seen in FIGS. 2 and 3, the closure body 36 includes a reduced diameter, generally cylindrical, upper portion 66 which terminates at the top of the closure body 36. The reduced diameter upper portion 66 defines an exterior, helical thread 68 and an interior horizontal wall or retaining deck 70. Projecting upwardly from the retaining deck 70 is a generally annular intermediate wall 72 and an inner hub 74. Projecting downwardly within the hub 74 is a tab 80 (FIG. 6). Between the intermediate wall 72 and the inner hub 74 are two flow passages 76 (one flow passage 76 being visible in FIG. 3 and the other flow passage 76 being visible in FIG. 2).

Near the bottom of the closure body cylindrical, upper portion 66 is an inwardly extending, circumferential bead 84 (FIG. 3). The bead 84 is adapted to engage, in a snap-fit relationship, the valve holder plate 34 which carriers the valves 32. The valve holder plate 34 has a pair of upwardly projecting walls 90 (FIGS. 2 and 3) which receive between them the downwardly projecting tab 80 of the closure body hub 74. In the preferred first embodiment illustrated in FIGS. 1–13, the valve holder plate 34 has a generally circular configuration with a peripheral bead 92 (FIGS. 2 and 3) which is adapted to be held in snap-fit engagement by the closure body interior bead 84. The closure body 36 is sufficiently resilient so that the valve holder plate 34 can be snap fit into the closure body 36 from the open bottom end of the closure body 36 during the assembly process. The valve holder plate 34 is not inserted into the closure body 36 until the valves 32 are initially disposed on the valve holder plate 34.

The valve holder plate 34 includes two discharge passages 102 (FIG. 2), and each discharge passage 102 is a generally cylindrical bore through the valve holder plate 34. As shown in FIG. 3, the valve holder plate 34 includes a frustoconical valve seat 104 around each discharge passage 102 for receiving one of the valves 32 in sealing relationship over the associated discharge passage 102.

The valve holder plate 34 includes two, annular seal flanges 108 which project downwardly and which are received within one of the container discharge openings 50 (FIG. 6) in a sealing relationship. The valve holder plate 34 also includes two, annular walls 112 each projecting upwardly around a different one of the valve seats 104 as shown in FIG. 3. The annular walls 112 laterally locate the valves 32 relative to the seats 104.

The preferred form of each valve 32 is similar to, and functionally analogously to, valve **3*d* disclosed in the U.S. Pat. No. 5,409,144 with reference to FIGS. 26–29 of the U.S. Pat. No. 5,409,144. The description of the valve 3*d*** disclosed in the U.S. Pat. No. 5,409,144 is incorporated herein by reference to the extent pertinent and to the extent not inconsistent herewith.

Figure 12:
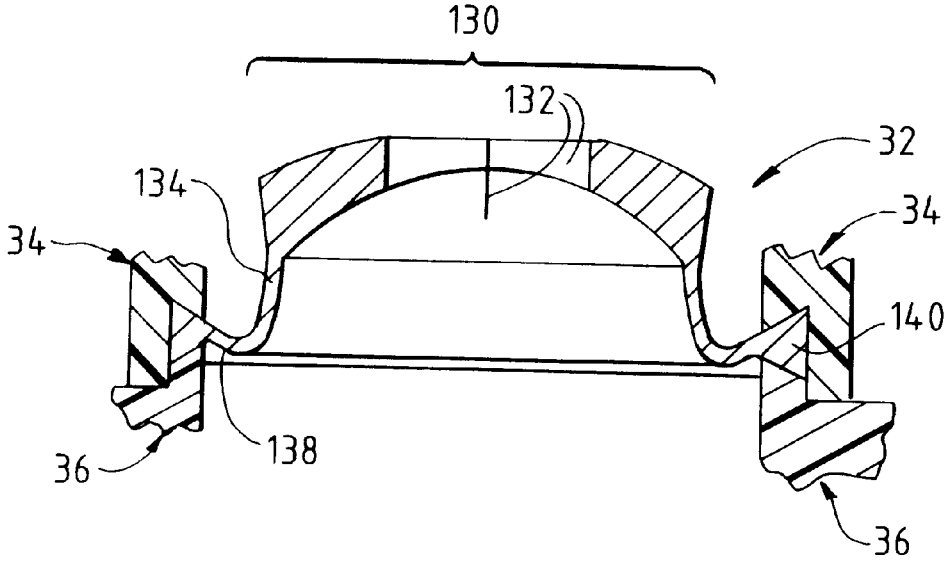
FIG. 12 is a fragmentary view of a portion of one of the valves shown closed in an inverted orientation which would occur when the package is inverted during the dispensing process.
Figure 13:
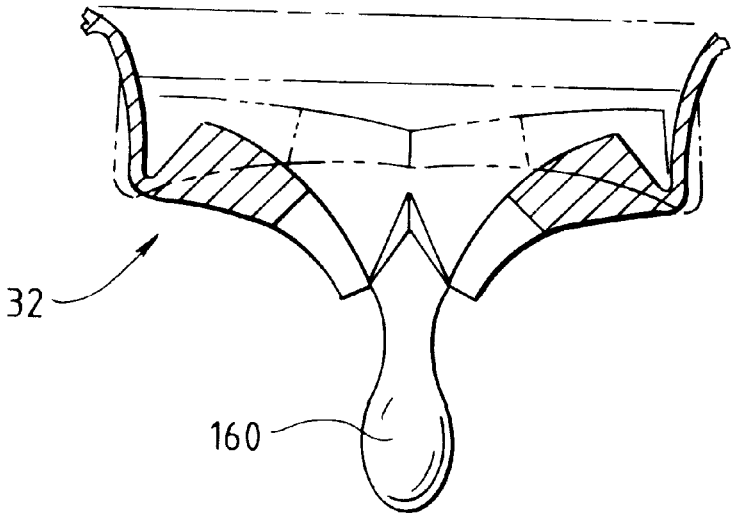
FIG. 13 is a view similar to FIG. 12, but FIG. 13 shows the valve in a substantially open configuration dispensing a product which is pressurized from an interior region above the valve.

The valve 32 is movable between a closed, rest position (shown in FIG. 12) and an active, open position (shown in an inverted package in FIG. 13). The valve 32 includes a flexible, central portion, face, or head portion 130 which has an unactuated, concave configuration (when viewed from the exterior) and has two, mutually perpendicular, intersecting, dispensing slits 132 of equal length which together define a closed dispensing orifice. The intersecting slits 132 define four, generally sector-shaped, flaps or petals in the concave, central, head portion 130. The flaps open outwardly from the intersection point of the slits 132, in response to increasing container pressure of sufficient magnitude, in the well-known manner described in the U.S. Pat. No. 5,409,144.

The valve 32 includes a skirt or sleeve 134 which extends from the valve central wall or head portion 130. At the outer end of the sleeve 134, there is a thin, annular flange 138 which extends peripherally from the sleeve 134 in a reverse, angled orientation. The thin flange 138 merges with an enlarged, much thicker, peripheral flange 140 which has a generally dovetail-shaped, transverse cross section (as viewed in FIG. 12).

To accommodate the seating of the valve 32 in the closure valve holder plate 34, the frustoconical configuration of the valve seat 104 has the same angle as the angle of the adjacent, bottom surface of the valve flange dovetail configuration.

The other (upper) surface of the valve flange 140 is clamped by the closure body retaining deck 70. Around the bottom of each flow passage 76 is a frustoconical surface 150 (FIG. 3) at an angle which matches the angle of the adjacent, upper surface of the valve flange dovetail configuration (FIG. 6).

This arrangement securely clamps and holds the valve 32 without requiring special internal support structures or bearing members adjacent the interior surface of the valve cylindrical sleeve 134. This permits the region adjacent the interior surface of the valve cylindrical sleeve 134 to be substantially open, free, and clear so as to accommodate movement of the valve sleeve 134 as described hereinafter.

The valve 32 is a resiliently flexible, molded structure which is preferably molded from a thermosetting elastomeric material, such as silicone rubber, natural rubber, and the like. The valve 32 could also be molded from a thermoplastic elastomer. Preferably, the valve 32 is molded from silicone rubber, such as the silicone rubber sold by The Dow Chemical Company in the United States of America under the trade designation DC-595.

The valve 32 could be molded with the slits 132. Alternatively, the valve slits 132 could be subsequently cut into the central head portion 130 of the valve 32 by suitable conventional techniques.

When the valve 32 is properly mounted within the valve holder plate 34 as illustrated in FIG. 6, the central head portion 130 of the valve 32 lies recessed within the plate 34. However, when the container 30 is squeezed to dispense the contents through the valve 32, then the valve head portion 130 is forced outwardly from its recessed position toward the end of the package top 38.

Figure 9:
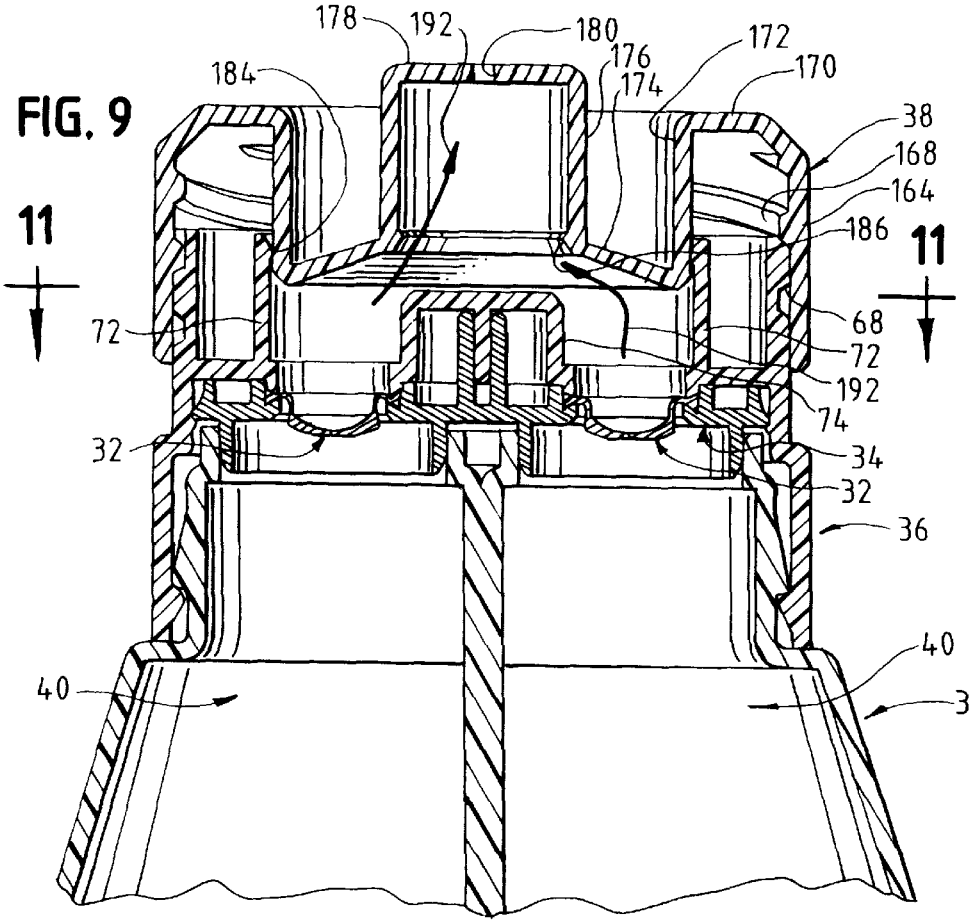
FIG. 9 is a fragmentary, cross-sectional view taken generally along the plane 9—9 in FIG. 8.
Figure 10:
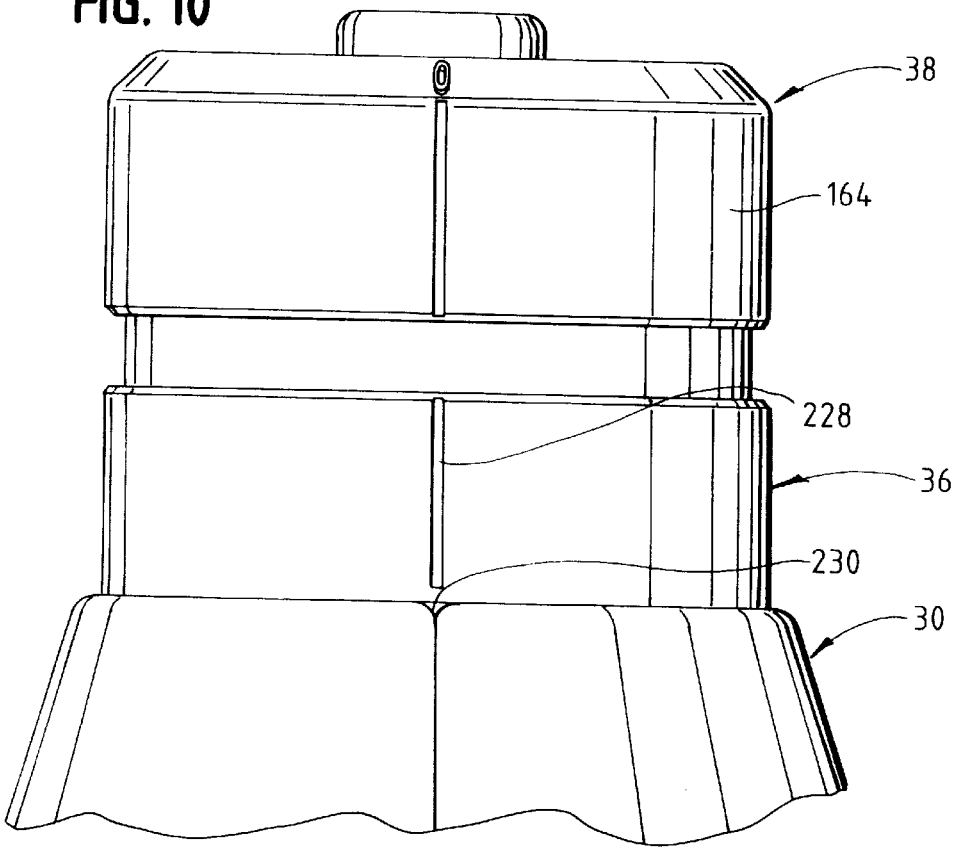
FIG. 10 is a fragmentary, side elevational view taken generally along the plane 10—10 in FIG. 8.

In use, the top 38 on the closure body 36 is first moved to the open position as shown in FIGS. 9 and 10 and as described in detail hereinafter. Then the package is inverted and squeezed. FIG. 12 shows orientation of a valve 32 when the container 30 is first inverted before the container 30 is squeezed. The container 30 is then squeezed to increase the pressure within the container 30 above the ambient exterior atmospheric pressure. This forces the constituent materials within the storage chambers of the container 30 toward the valves 32 and forces the valves 32 from the recessed or retracted positions (FIG. 12) toward an outwardly extending position (shown in FIG. 13). The outward displacement of the central head portion 130 of each valve 32 is accommodated by the relatively, thin, flexible sleeve 134. The sleeve 134 moves from an inwardly projecting, rest position (shown in FIG. 12) to an outwardly displaced, pressurized position, and this occurs by the sleeve 134 "rolling" along itself outwardly toward the outside end of the package (toward the position shown in solid lines in FIG. 13). However, the valve 32 does not open (i.e., the slits 132 do not open) until the valve central head portion 130 has moved substantially all the way to a fully extended position (FIG. 13). Indeed, as the valve head portion 130 begins to move outwardly, the valve head portion 130 is initially subjected to radially inwardly directed compression forces which tend to further resist opening of the slits 132. Also, the valve central head portion 130 generally retains its inwardly concave configuration as it moves outwardly and even after it reaches the fully extended position. However, when the internal pressure becomes sufficiently high after the valve central head portion 130 has moved outwardly to the fully extended position, then the slits 132 of the valve 32 open to dispense the fluent material (FIG. 13). The fluent material is then expelled or discharged through the open slits 132. For illustrative purposes, FIG. 13 shows a drop 160 of a liquid, fluent material being discharged.

When the squeezing pressure on the container 30 is released, the valve 32 closes, and the valve head 130 retracts to its recessed, rest position within the valve holder plate 34. If the container 30 is not being squeezed, the weight of the fluent material on the valve 32 does not cause the valve 32 to open, or to remain open.

The above-discussed dispensing action of each of the valves 32 typically would occur only after (1) the system top 38 has been moved to the open position (FIGS. 9–11), (2) the package is inverted, and (3) the container is squeezed. To this end, the top 38 is moveable between a lower, closed position shown in FIGS. 4–7 and an open position shown in FIGS. 8–11. The top 38 includes a peripheral skirt 164 (FIG. 9). The top skirt 164 defines an internal thread 168 adapted to threadingly engage the closure body external thread 68 as shown in FIGS. 6 and 9. Rotation of the top 38 in one direction causes the top 38 to move axially upwardly away from the lowered position shown in FIG. 6 to its fully elevated position shown in FIG. 9. Rotation of the top 38 in the other direction lowers the top 38.

Figure 8:
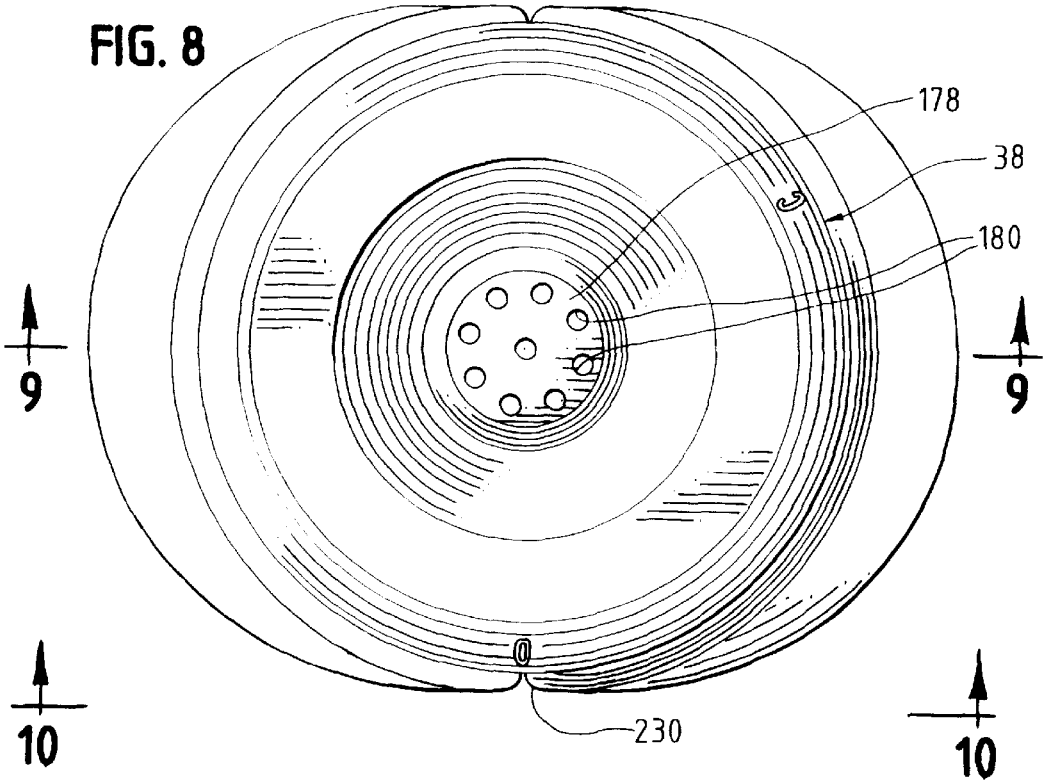

The top 38 defines an outer, upper, annular deck 170, a cylindrical, intermediate wall 172, a frustoconical, annular, recessed deck 174, a cylindrical, inner wall 176, and a central baffle 178 (FIG. 9). The central baffle 178 includes or defines a plurality of apertures 180 (FIGS. 8 and 9).

The top intermediate wall 172 is adapted to sealingly engage the closure body intermediate wall 72. To this end, the upper, inner edge of the closure body intermediate wall 72 has a small, inwardly projecting, annular, seal rib or bead 184 (as best seen in FIGS. 3 and 9) for sealingly engaging the exterior surface of the cylindrical intermediate wall 172 of the top 38.

The bottom end of the top cylindrical, inner wall 176 defines a sealing bead 186 for engaging the cylindrical surface of the hub 74 of the closure body 36 when the top 38 is moved into the lowered, closed position as shown in FIG. 6.

With reference to FIG. 9, the twist top 38 may be characterized as defining at least one interior dispensing flow path defined under the frustoconical, recessed deck 174 and within the cylindrical, inner wall 176. The interior dispensing flow path is schematically illustrated by arrows 192 in FIG. 9. The interior dispensing flow path 192 communicates with the apertures 180 in the baffle 178.

When the twist top 38 is in the fully lowered, closed position illustrated in FIG. 6, then the interior dispensing flow path 192 is blocked, occluded, or closed by the frustoconical recessed deck 174 as shown in FIG. 6. A sealed closed condition is maintained because of the engagement of the annular rib 186 with the exterior surface of the hub 74 and because of the engagement between the annular seal bead 184 of the closure body intermediate wall 72 with the twist top intermediate wall 172. The configuration of the twist top intermediate wall 172, recessed deck 174, and cylindrical, inner wall 176 may together be characterized as an occlusion structure or occlusion member that cooperates with the closure body 36 when the top 38 is in the lowered position (FIG. 6) so as to occlude the interior dispensing flow path 192 and prevent the fluent product or material from being dispensed from the system. However, when the twist top 38 is rotated to effect axial elevation of the twist top 38 relative to the closure body 36, then the interior dispensing flow path 192 is open as shown in FIG. 9 to permit the dispensing of the fluent product. Of course, the fluent materials in each storage chamber 40 (FIG. 9) do not mix and form a combination product until they have been forced through the valves 32. Typically, this does not occur until the package is inverted and the twist top 38 rotated to the fully opened position. Then, a squeezing force is applied to the container 30 to force the fluent materials from a storage chambers 40 through the valves 32 and into the interior dispensing flow path 192. The interior dispensing flow path 192 may be alternatively characterized as a mixing chamber wherein the two fluent materials mix and combine to form a combination product which is then forced through the apertures 180 in the dispersion baffle 178.

Figure 4:
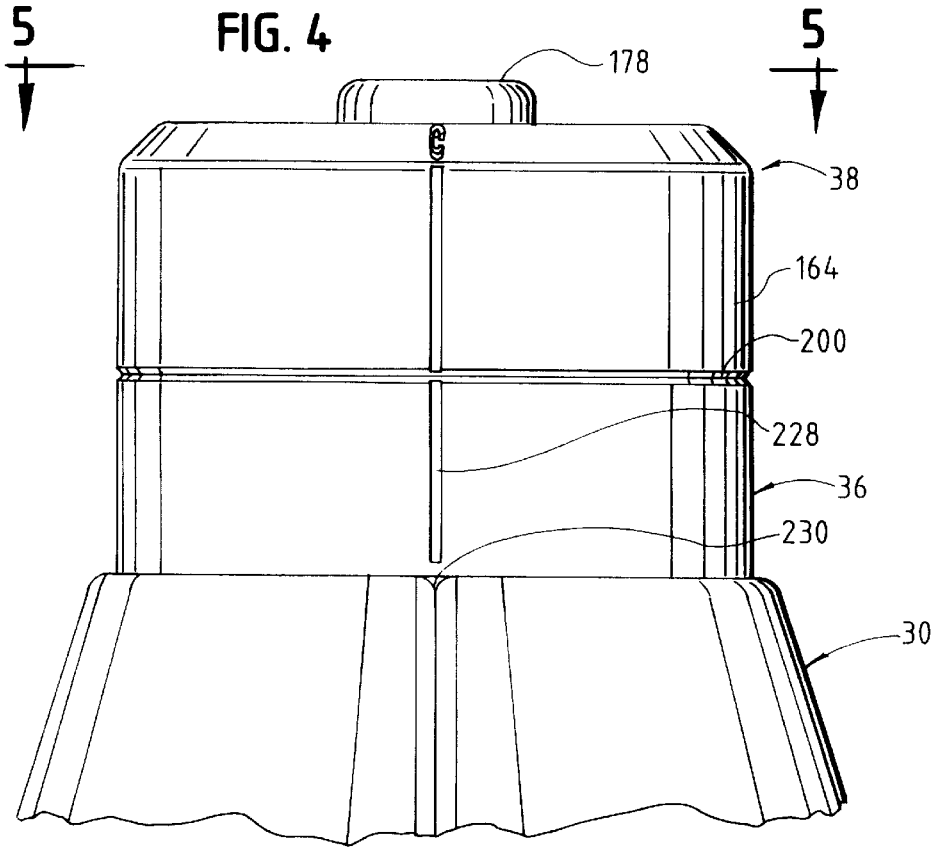
FIG. 4 is a fragmentary, side elevational view of the dispensing system of the first embodiment of the dispensing system taken generally along the plane of 4—4 in FIG. 1.

With reference to FIGS. 4 and 6, it will be appreciated that when the twist top 38 is in the fully lowered, closed position, the bottom edge of the twist top skirt 164 engages a shoulder 200 on the closure body 36 at the bottom of the reduced diameter portion 66 (which reduced diameter portion 66 is clearly designated in FIG. 2). This engagement between the bottom of the twist top skirt 164 and the closure body 36 terminates the downward closing movement of the twist top 38.

Figure 7:
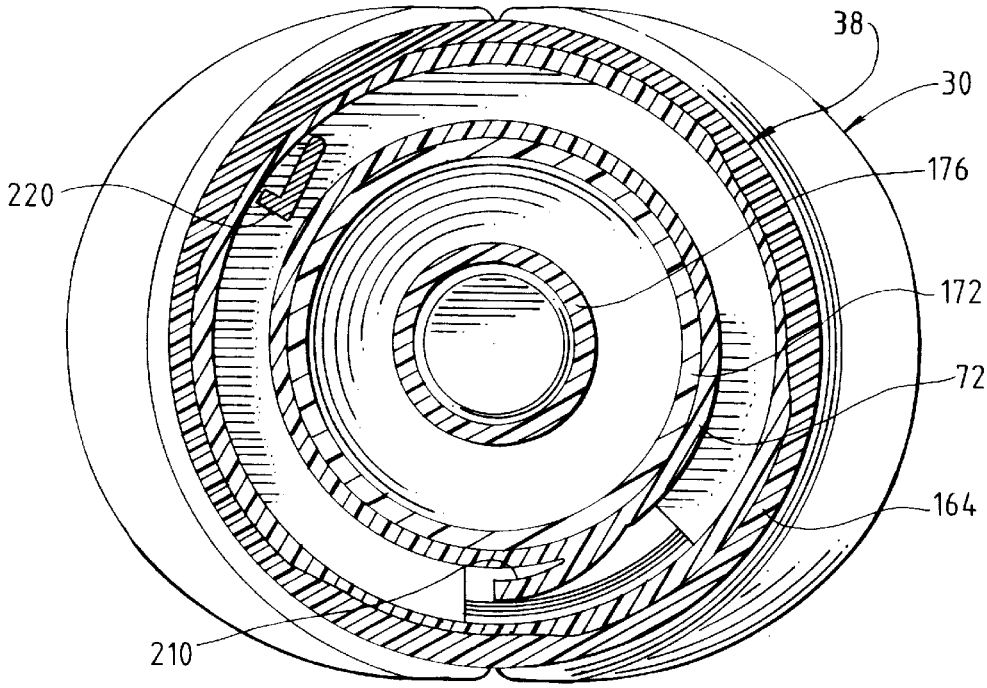
FIG. 7 is a cross-sectional view taken generally along the plane 7—7 ir FIG. 6.
Figure 11:
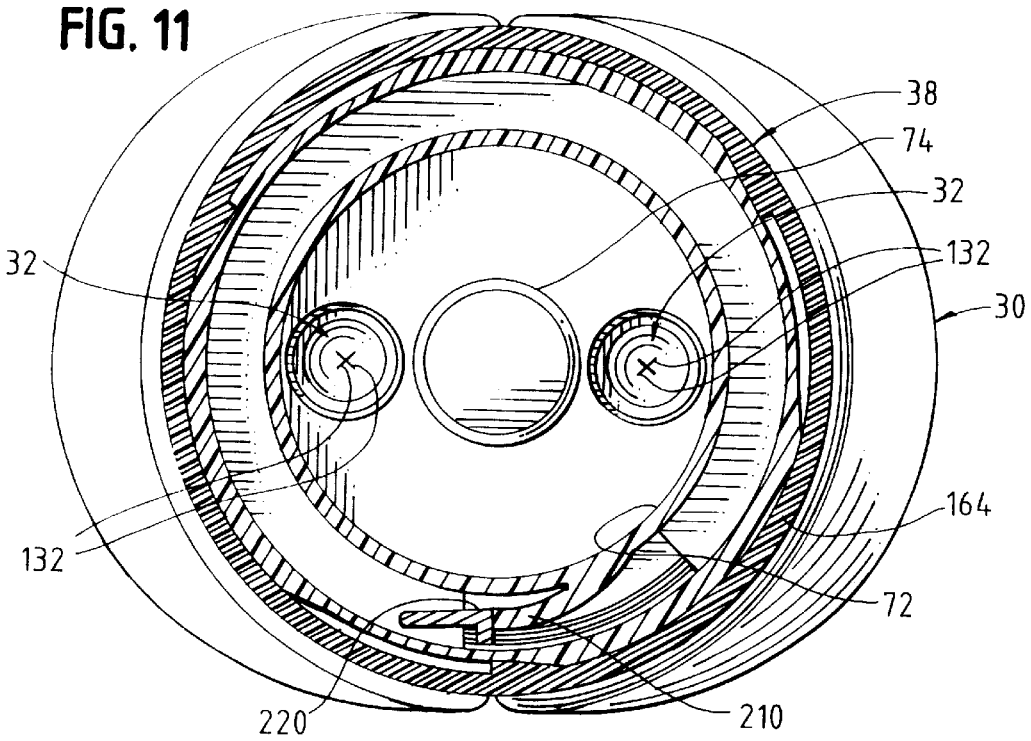
FIG. 11 is a cross-sectional view taken generally along the plane 11—11 in FIG. 9.

The system also preferably includes a feature to terminate the upward, opening movement of the twist top 38 when the twist top 38 is rotated in the other direction to open the system to the position illustrated in FIGS. 8–11. This feature includes a flexible abutment member 210 which extends outwardly in a cantilevered fashion from the closure body cylindrical, intermediate wall 72. The abutment member 210 is adapted to cooperate with an engaging tab or member 220 which extends downwardly from the twist top outer, annular top deck 170 (as shown in FIG. 6), and which has a reversed L-shaped configuration in cross section (as shown in FIGS. 7 and 11). The engaging tab 220 necessarily rotates with the twist top 38 when the twist top 38 is rotated on the closure body 36. The engaging tab 220 is located somewhat less than an 180° from the stationary abutment 210 when the twist top 38 is in the fully closed, fully lowered position (FIGS. 7, 6, 5, and 4). When the twist top 38 is rotated toward the fully opened, fully elevated position (i.e., rotated counterclockwise as viewed in FIGS. 7 and 11), the tab 220 is carried into engagement against the abutment 210, and this prevents further rotation of the twist top 38 in the opening direction. This prevents the twist top 38 from being unscrewed off of the closure body 36.

Figure 5:
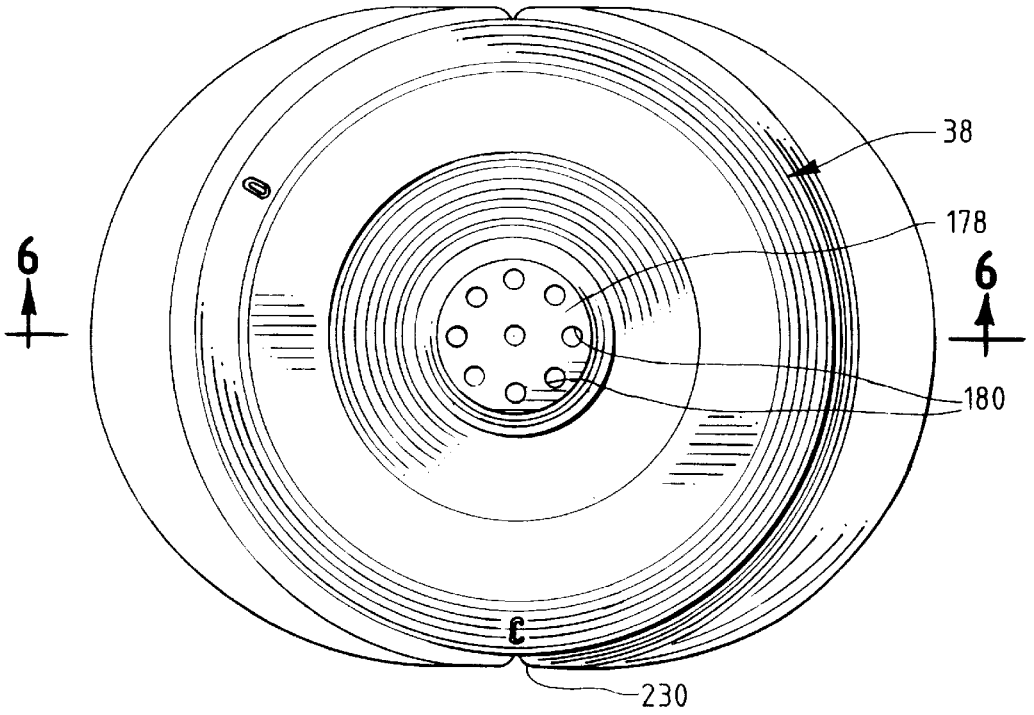
FIG. 5 is a top plan view taken generally along the plane 5—5 in FIG. 4.

FIG. 1 illustrates the twist top 38 in the fully lowered, fully closed position. An indicium "C" is provided on the top of the twist top 38 at a location which is in alignment with a line 228 on the closure body 36 and a notch 230 on the shoulder of the container 30 when the twist top 38 is in the fully closed position as shown in FIGS. 1, 4, and 5. When the twist top 38 is rotated to the fully elevated, fully opened position shown in FIGS. 8–11, an indicium "O" on the top of the twist top 38 moves into alignment with the closure body line 228 and container notch 230 to indicate the fully opened condition.

It will be appreciated that during assembly of the components by the manufacturer of the system, the twist top 38 must be initially screwed onto the closure body 36. This can be done because either the abutment member 210 or the engaging member 220, or both, are sufficiently flexible when subjected to the forces arising during the screwing-on assembly process. In particular, the abutment tab 210 may be sufficiently flexible so that it can be forced somewhat radially inwardly toward the closure body intermediate wall 72 as the leading end of the engaging tab 220 moves against the radially exterior surface of the abutment member 210. The engaging tab 220 may also be sufficiently flexible so that it can deflect somewhat radially outwardly to permit the engaging tab 220 to pass the abutment member 210. Because the engaging tab 220 is connected only at the top of the tab 220 to the twist top outer, annular deck 170, the engaging tab 220 will be relatively flexible in the radially outward direction if the twist top 38 is molded from conventional thermoplastic materials, such as polypropylene or the like.

Owing to the shape of the abutment member 210 and engaging tab 220, either or both the abutment member 210 and engaging tab 220 can deflect sufficiently to permit the engaging tab 220 to slide past the abutment member 210. However, owing to the shapes of the abutment member 210 and engaging tab 220, an attempt to unscrew the twist top 38 from the closure body 36 will be unsuccessful, and the engagement between the engaging tab 220 and abutment member number 210 will function only to terminate the opening movement of the twist top 38 at the fully elevated, fully opened position as shown in FIGS. 8–11.

It will be appreciated that if a mixing chamber for the constituent materials from the container storage chambers 40 is not necessary or desired, then the twist top 38 could be eliminated. Further, if the twist top 38 is eliminated, then the closure body 36 could be greatly simplified as it needs merely to function as a member for retaining the valves 32 in the valve holder plate 34.

Figure 14:
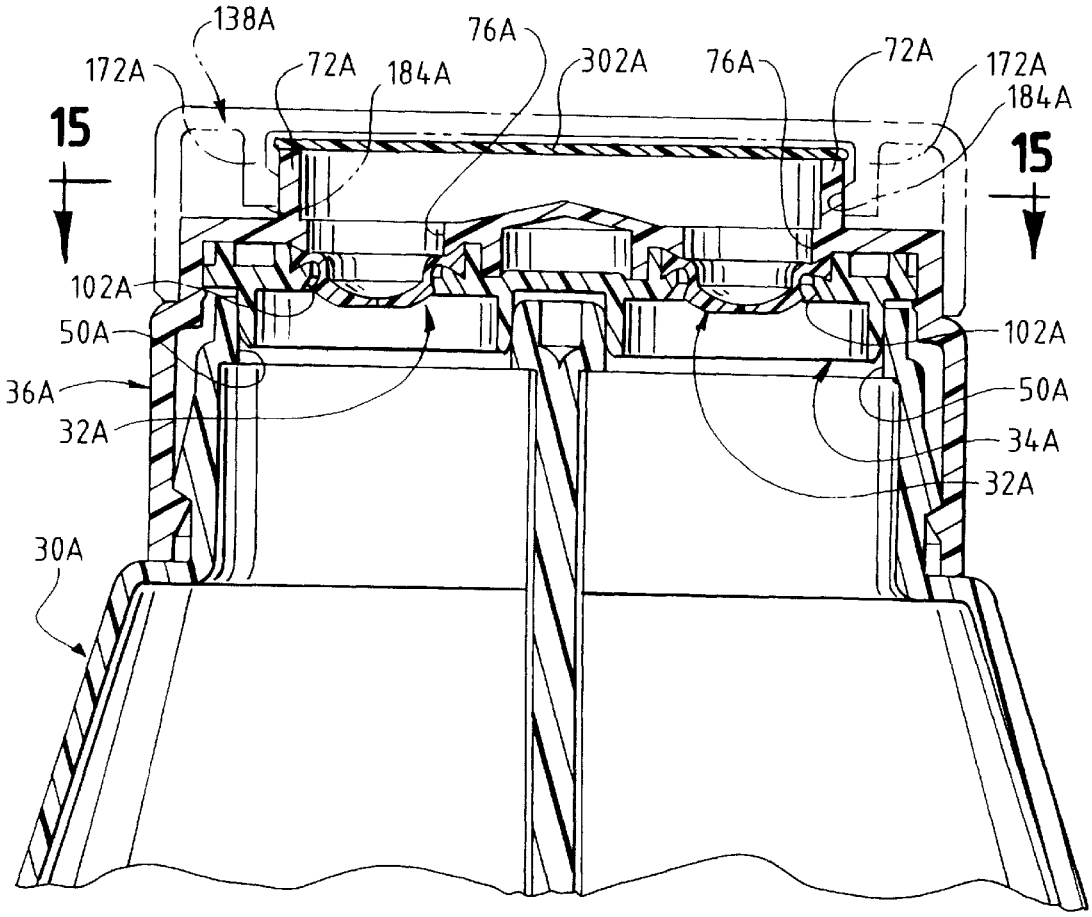
FIG. 14 is a fragmentary, cross-sectional view of a second embodiment of a dispensing system of the present invention.
Figure 15:
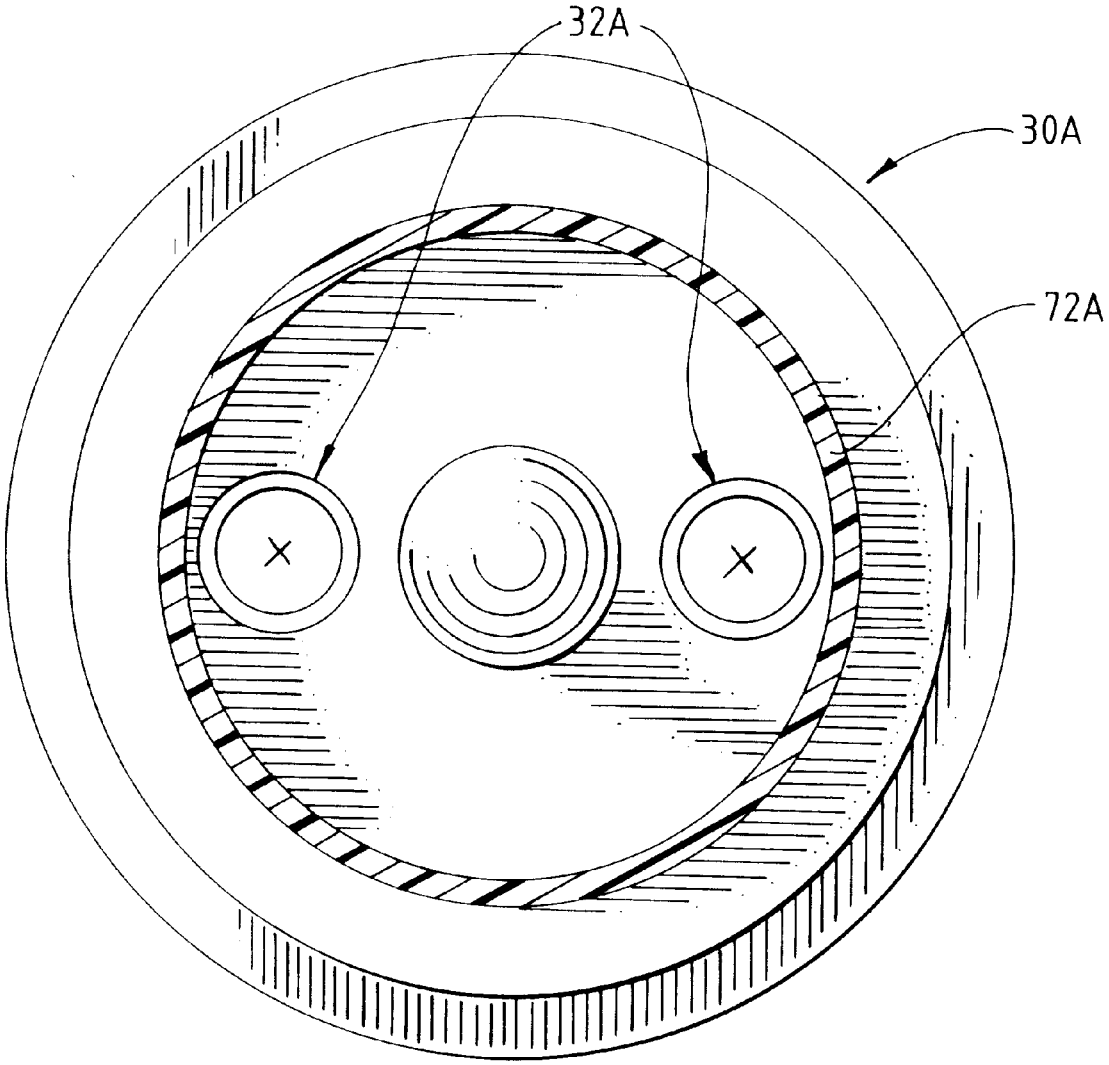
FIG. 15 is a cross-sectional view taken generally along the plane 15—15 in FIG. 14.

A second embodiment of a dispensing system in accordance with the present invention is illustrated in FIGS. 14 and 15. The second embodiment is a package which includes a container 30A which has substantially the same structure as the container 30 described above for the first embodiment illustrated in FIGS. 1–13.

The second embodiment of the package includes a closure body 36A which is snap fit onto the container 30A in substantially the same manner that the first embodiment closure body 36 is mounted to the first embodiment container 30 as discussed above with reference to FIGS. 1–13.

The second embodiment closure body 36A receives a valve holder plate 34A which is similar to the valve holder plate 34 of the first embodiment described above with reference to FIGS. 1–13. The container 30A defines a pair of discharge openings 50A which communicate with discharge passages 102A defined in the valve holder plate 34A. Disposed on the valve holder plate 34A over each discharge passage 102A is a valve 32A. Each valve 32A is identical to the first embodiment valve 32 described above with reference to FIGS. 1–13. Each valve 32A is clamped against the valve holder plate 34A by an overlying deck portion of the closure body 36A which defines a flow passage 76A above, and in registry with, one of the valves 32A.

The closure body 36A includes an upwardly extending, annular wall 72A. The wall 72A may function as a short discharge spout. To this end, when the package is inverted and squeezed, the constituent materials from the container 30A are discharged through the valves 32A and combined or mixed on the discharge sides of the valves 32A within the spout 72A to form a combination product.

In one presently contemplated embodiment, a lid 138A may be provided for mounting on the closure body 36A. The lid 138A is shown in phantom with dashed lines in FIG. 14. The lid 138A includes a downwardly extending, annular, sealing collar or flange 172A with a radially inwardly extending sealing bead 184A. The bead 184A engages the exterior cylindrical surface of the annular wall or spout 72A.

The lid 138A may be a separate piece that is completely removable from the package. Alternatively, the lid 138A could be hingedly connected to the closure body 36A by means of a suitable hinge structure, such as living hinge, a strap hinge, or a snap-action hinge (not illustrated). Whether or not a lid 138A is employed, it may be desirable in some applications to provide a peel-away seal 302A which is self-adhered to the top end of the closure body annular spout 72A and which it can be pulled away from the spout 72A prior to use. Such a seal 302A may be especially useful as a shipping seal to prevent inadvertent discharge from the container 30A during shipping and storage. Such a seal 302A could also be provided in a tampered-evident form which would leave a torn portion on part of the closure body 36A to indicate removal of, or tampering with, the seal 302A.

Figure 16:
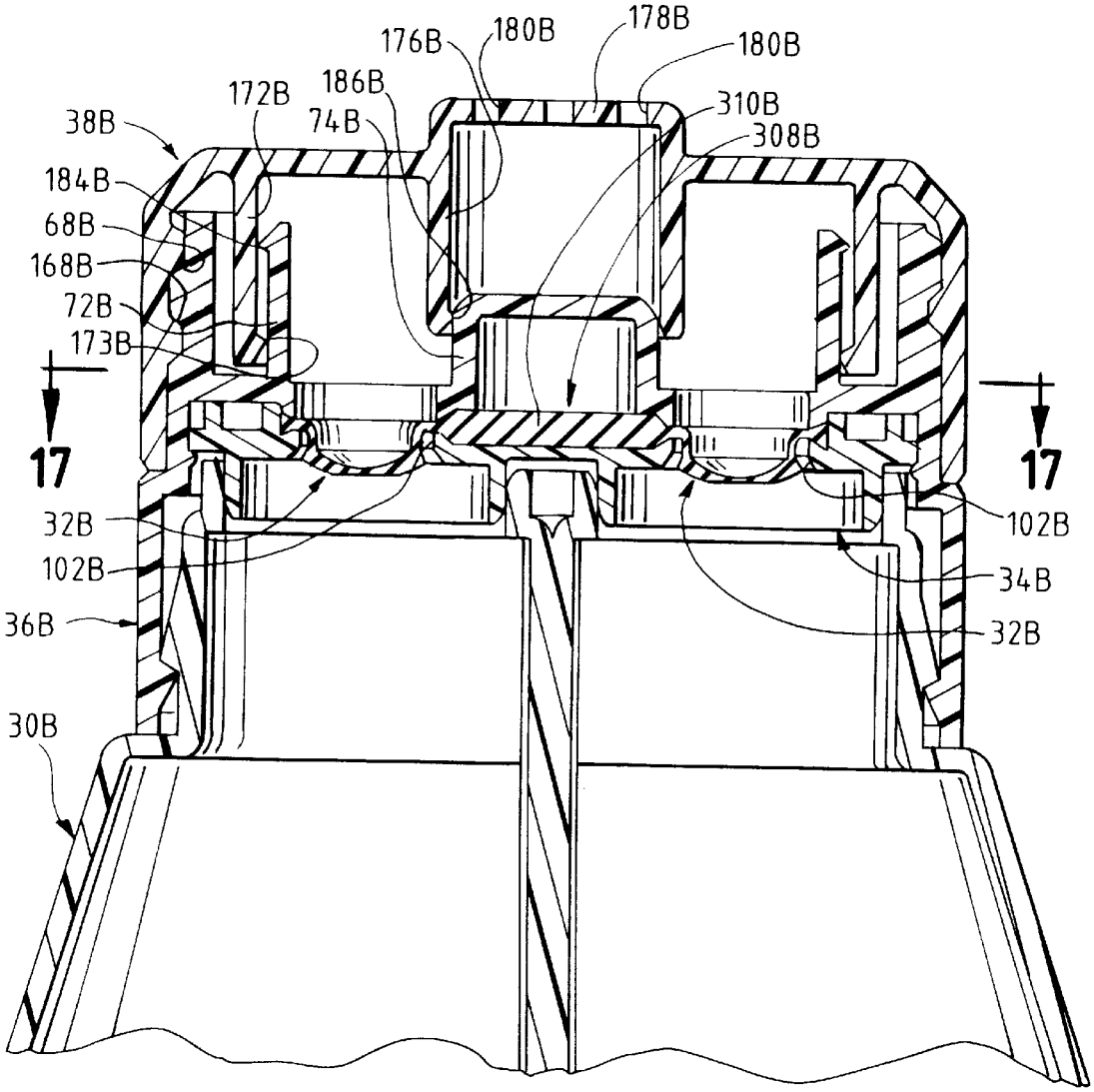
FIG. 16 is a fragmentary, cross-sectional view of a third embodiment of a dispensing system of the present invention.
Figure 17:
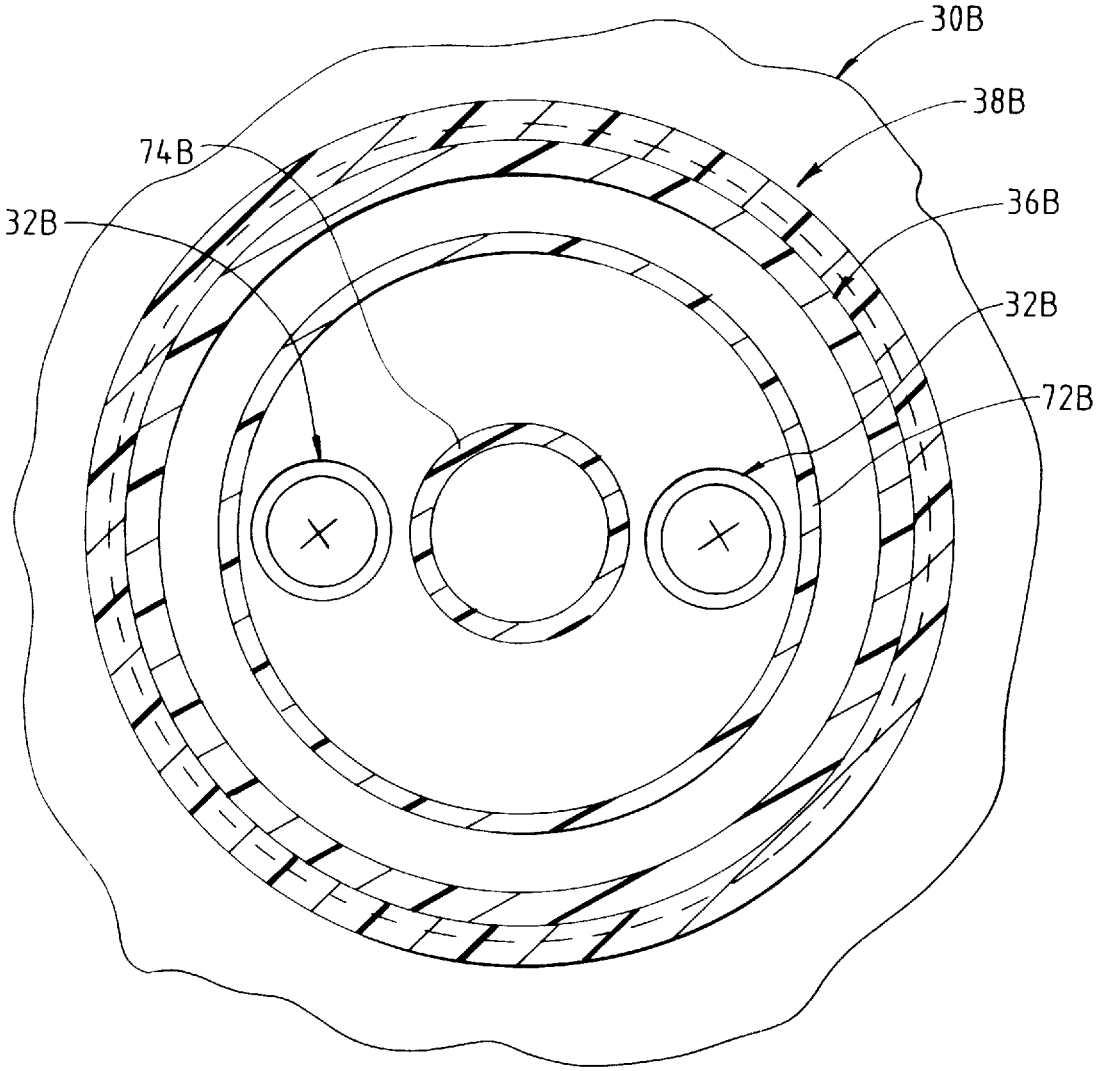
FIG. 17 is a cross-sectional view taken generally along plane 17—17 in FIG. 16.

FIGS. 16 and 17 illustrate a third embodiment of the present invention in the form of a package that includes a container 30B, an array o valves 32B, a closure body 36B, a valve holder plate 34B, and a twist top 38B.

The container 30B is substantially identical to the container 30 for the first embodiment described above with reference to FIGS. 1–13. The closure body 36B is substantially similar to the first embodiment closure body 36 described above with reference to FIGS. 1–13 except that the third embodiment closure body 36B has an annular, intermediate wall 72B with a sealing bead 184B which is oriented radially outwardly (rather than radially inwardly like the bead 184 in the first embodiment as shown in FIGS. 3 and 6). The radially outwardly directed sealing bead 184B is adapted to engage the inner cylindrical surface of an annular, intermediate wall 172B which projects downwardly on the inside of the twist top 38B. The bottom end of the intermediate wall 172B includes a radially inwardly directed sealing bead 173B for engaging the outer, cylindrical surface of the annular, intermediate wall 72B in the closure body 36B.

The central part of the closure body 36B defines a hub having a cylindrical wall 74B. The exterior cylindrical surface of the wall 74B is adapted to be sealingly engaged by a seal bead 186B at the bottom end of an annular wall 176B which projects downwardly from the twist top 38B within the intermediate wall 172B. The upper, central portion of the twist top 38B defines a deck or baffle 178B which includes a plurality of dispensing apertures 180B.

The system includes two valves 32B which are each disposed within discharge passage 102B in the valve holder plate 34B. Each valve 32B is molded as a unitary portion of a single piece of an elastomeric material 308B which has a thickened, central region 310B. The piece of elastomeric material 308B is clamped against the valve holder plate 34B by the overlying portions of the closure body 36B. The piece of elastomeric material 308B may be alternatively characterized as a valve array structure which includes the valves 32B as unitary portions thereof. The valve array structure or elastomeric material 308B is a unitary, resiliently flexible, molded structure which is preferably molded from a thermoplastic elastomeric material, such as silicone rubber, natural rubber and the like. The structure 308B could also be molded from a thermoplastic elastomer. Preferably, the structure 308B is molded from a silicone rubber, such as the silicone rubber sold by The Dow Chemical Company in the United States of America under the trade designation DC-595. The configuration and operation of each valve 32B within the elastomeric structure 308B are substantially identical to the configuration and operation of the first embodiment valves 32 described above with reference to FIGS. 1–13.

The closure body 36B includes a helical thread 68B, and the twist top 38B includes a mating helical thread 168B. It will be appreciated that rotation of the twist top 38B in one direction will cause the twist top 38B to move downwardly to the fully lowered, closed position illustrated in FIG. 16. Rotation of the twist top 38B in the opposite direction will cause a twist top 38B to rise until the annular seal wall 176B on the inside of the twist top 38B becomes disengaged from the closure body hub wall 74B. This opens the interior dispensing flow path defined under the twist top 38B. The package can then be inverted and squeezed to force the constituent materials from the container 30B through the valves 32B into the interior dispensing flow path defined adjacent the elevated, opened twist top 38B. This interior dispensing flow path also functions as a mixing chamber wherein the constituent materials mix to form a combination product which then flows out through the dispensing apertures 180B.

A rotation stop system is provided for preventing the twist top 38B from being rotated beyond a certain raised elevation. The rotation stop system employs the annular sealing bead 173B and annular sealing bead 184B which function as engaging members. The profiles of these beads permit them to slide past each other during assembly of the body 36B and top 38B. However, after assembly, the beads 173B and 184B will engage when the top 38B is rotated to raise the bead 173B to the elevation of the bead 184B, and the bead profiles catch each other to prevent further upward movement of the top 38B.

When the twist top 38B is in the fully lowered, closed position as illustrated in FIG. 16, the package is substantially leak proof, and the package may be shipped and stored in such a configuration.

Depending upon the size, distribution, and arrangement of the apertures 180B in the top of the twist top 38B, a variety of dispensing flow configurations may be achieved, including sprinkling or spraying configurations or patterns.

Figure 18:
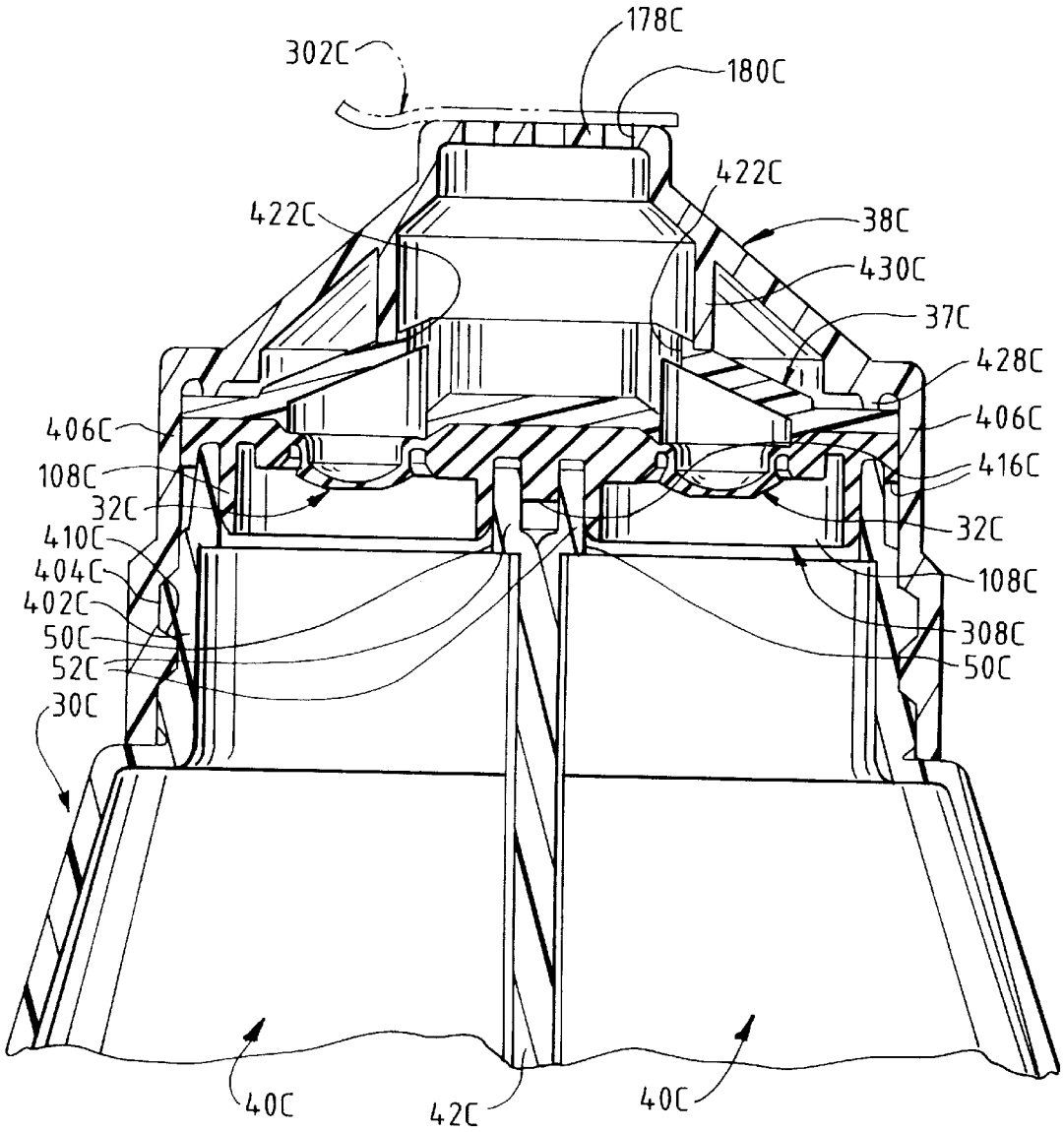
FIG. 18 is a fragmentary, cross-sectional view of a fourth embodiment of a dispensing system of the present invention.
Figure 19:
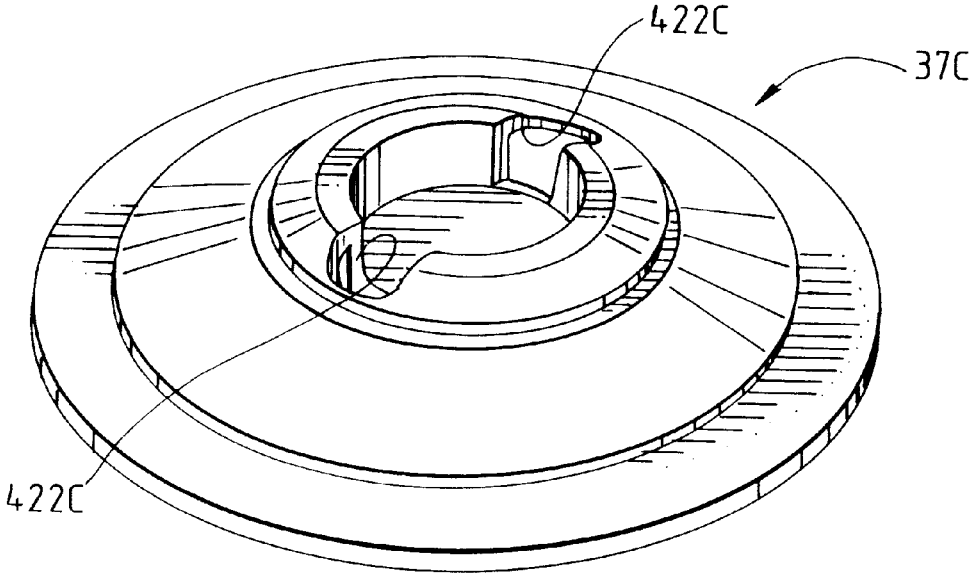
FIG. 19 is a top, perspective view of a retaining deck employed in the fourth embodiment of the present invention.
Figure 20:
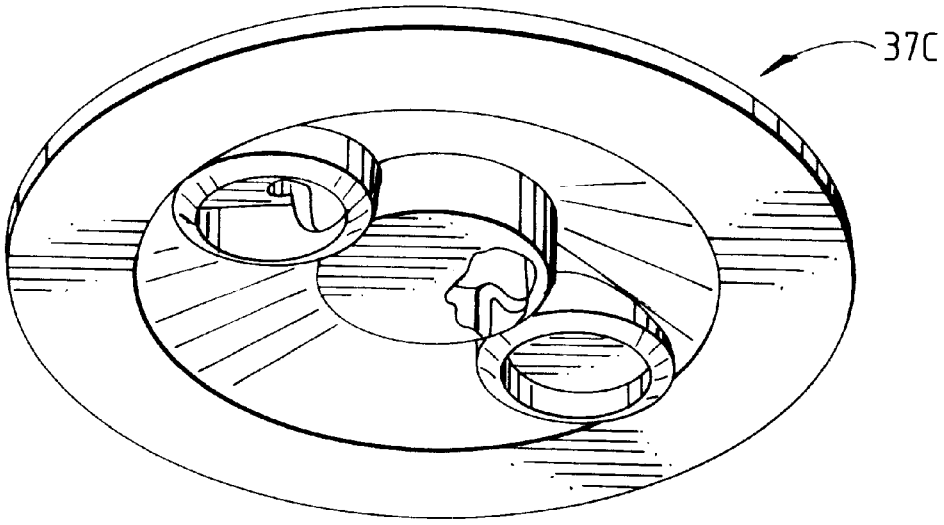
FIG. 20 is a bottom, perspective view of the retaining deck illustrated in FIG. 19.

A fourth embodiment of the present invention is illustrated in FIGS. 18–20 in the form of a package which includes a container 30C, a unitary, valve array structure or piece 308C with integral valves 32C, a retainer plate 37C, and a top 38C. The container 30C is similar to, but not exactly the same as, the container 30 in the first embodiment discussed above with reference to FIGS. 1–13. In particular, the upper end of the fourth embodiment container 30C defines a neck 402C which has an exterior, helical thread 404C. The system does not include a closure body such as the closure body 36 in the first embodiment described above with reference to FIGS. 1–13. Instead, the fourth embodiment top 38C has a skirt 406C which directly receives the neck 402C of the container. The skirt 406C defines an internal helical thread 410C which is threadingly engaged with the container neck thread 404C.

The container 30C defines two storage compartments or chambers 40C which are internally separated by a dividing wall structure 42C. The upper end of the container neck defines a pair of cylindrical collars 52C which each define a discharge opening 50C communicating with one of the container storage chambers 40C.

Each valve 32C is formed as a unitary portion of the single piece, elastomeric valve array structure 308C. The single piece 308C incorporates each valve 32C as a unitary portion thereof and further acts as a valve holding structure for holding the valves 32C within the container discharge openings 50C. Thus, unlike the first three embodiments described above with reference to FIGS. 1–17, the fourth embodiment does not incorporate a separate a valve holder plate (such as the first embodiment valve holder plate 34, the second embodiment valve holder plate 34A, or the third embodiment valve holder plate 34B). Instead, the single, elastomeric piece 308C includes two, internal, seal flanges 108C, one in each discharge opening 50C. Each seal flange 108C seals against the inside cylindrical surface of the surrounding container collar 52C. Further, the elastomeric piece 308C includes downwardly extending, peripheral portions 416C which sealingly engage the exterior cylindrical surface of each container collar 52C. The downwardly extending portions 416C merge and extend between the two collars 52C along the longitudinal center line of the container 30C.

Each valve 32C is molded as an unitary portion of the elastomeric piece 308C so as to provide valve structures which are substantially identical to, and which operate in the same manner as, valves 32, 32A and 32C of the first embodiment, second embodiment, and third embodiment, respectively, described above.

The elastomeric piece 308C is clamped from the top by the retainer member 37C. The retainer 37C has a generally disk-alike configuration as can be seen in FIGS. 19 and 20. The retainer plate 37C also defines openings or passages 422C for establishing communication from the valves 32C through the system.

The elastomeric piece 308C may be molded from the same material employed for molding the first embodiment valves 32 described above with reference to the FIGS. 1–13. The above-described structure of the elastomer piece 308C provides an effective sealing engagement with the upper end of the container 30C so that the piece 308C thus also functions as a gasket for sealing the top of the container 30C.

The top 38C engages the upper surface of the retainer 37C. The retainer 37C is pressed by the top 38C tightly against the elastomeric piece 308C owing to the threaded engagement between the top 38C and the neck 402C of the container 30C. The top 38C presses against the retainer 37C along two concentric, annular regions of the retainer 37C—an outer, annular region engaged by an outer, annular bead 428C of the top 38C, and an inner, annular region engaged by an inner, annular flange 430C projecting from the inside of the top 38C.

The distal end of the top 38C defines and includes a deck or baffle 178C which defines a plurality of dispensing apertures 180C. The size and arrangement of the apertures 180C may be varied to provide a desired spray pattern or sprinkling pattern. Alternatively, only one, large aperture 180C can be provided to facilitate the dispensing of the product as a single stream.

In some applications, it may be desirable to additionally provide a shipping seal 302C over the apertures 180C. The shipping seal 302C can have a suitable adhesive for securing the seal 302C to the upper surface of the top 38C, and such an adhesive would permit the seal 302C to be readily pealed away prior to use. When the seal 302C is in place, inadvertent discharge of the product from the container is prevented. Thus, the seal 302C can be advantageously employed by the manufacturer to initially seal the package and prevent leakage during shipping, storage, and handling prior to use.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing system comprising:

a container having at least two interior storage chambers for each holding a different fluent material, each said storage chamber including an associated, separate discharge opening;

at least two, resiliently flexible valves each associated with, and sealingly disposed over, a different one of said discharge openings, each said valve having an initially closed dispensing orifice which opens in response to a differential between the pressure acting against the side of the closed valve facing toward the associated discharge opening and the pressure acting against the side of the closed valve facing away from the associated discharge opening;

said system including a closure body that is mounted to said container over said discharge openings; and said system including a valve holder plate that (1) is a separate structure retained within said closure body, (2) is disposed in sealing relationship with said container around said container discharge openings, (3) has at least two discharge passages each disposed over a different one of said container discharge openings, and (4) defines at least two seats each defined around a different one of said discharge passages for receiving one of said valves in sealing relationship over a different one of said discharge passages.

2. The system in accordance with claim 1 in which said closure body includes a retaining deck over said valve holder plate;

said retaining deck defines at least two flow passages each aligned with a different one of said discharge passages in said valve holder plate; and said retaining deck sealingly engages a peripheral portion of each of said valves.

3. A dispensing system comprising:

a container having at least two interior storage chambers for each holding a different fluent material, each said storage chamber including an associated, separate discharge opening;

at least two, resiliently flexible valves each associated with, and sealingly disposed over, a different one of said discharge openings, each said valve having an initially closed dispensing orifice which opens in response to a differential between the pressure acting against the side of the closed valve facing toward the associated discharge opening and the pressure acting against the side of the closed valve facing away from the associated discharge opening;

said system including a closure body that is mounted to said container over said discharge openings;

said system including a valve holder plate that (1) is retained within said closure body, (2) is disposed in sealing relationship with said container around said container discharge openings, (3) has at least two discharge passages each disposed over a different one of said container discharge openings, and (4) defines at least two seats each defined around a different one of said discharge passages for receiving one of said valves in sealing relationship over a different one of said discharge passages;

said closure body including a retaining deck over said valve holder plate;

said retaining deck defines at least two flow passages each aligned with a different one of said discharge passages in said valve holder plate; and said retaining deck sealingly engaging a peripheral portion of each of said valves;

said system further including a top mounted by threaded engagement on said closure body for movement between an elevated position and a lowered position;

said top defining at least one interior dispensing flow path from said closure body and at least one dispensing aperture that is in communication with said interior dispensing flow path to accommodate the dispensing of a fluent product from said system; and said top defining an occlusion member that (a) cooperates with said closure body when said top is in said lowered position to occlude said interior dispensing flow path and prevent product from being dispensed from said system, and (b) opens said interior dispensing flow path when said top is moved away from said lowered position to permit the dispensing of a fluent product.

4. The system in accordance with claim 3 further including a flexible, peel-away seal strip releasably self-adhering to said top to seal closed said at least one aperture in said top.

5. The system in accordance with claim 3 in which said closure body includes an abutment member; and said top includes an engaging member shaped to engage said abutment member and prevent movement of said top beyond a predetermine elevated position on said closure body.

6. The system in accordance with claim 5 in which said abutment member and said engaging member are shaped to slid against each other when said top is initially screwed onto said closure body; and said top and closure body are sufficiently flexible to accommodate movement of said engaging member past said abutment member when said top is initially screwed onto said closure body to locate said top at said lowered position.

7. A dispensing system comprising:

a container having at least two interior storage chambers for each holding a different fluent material, each said storage chamber including an associated, separate discharge opening; and a single piece of elastomeric material which includes at least two resiliently flexible valves each associated with, and sealingly disposed over, a different one of said discharge openings, each of said valves molded as unitary portions of said single piece of elastomeric material, each said valve having an initially closed dispensing orifice which opens in response to a differential between the pressure acting against the side of the closed valve facing toward the associated discharge opening and the pressure acting against the side of the closed valve facing away from the associated discharge opening.

8. A dispensing system comprising:

a container having at least two interior storage chambers for each holding a different fluent material, each said storage chamber including an associated, separate discharge opening;

at least two, resiliently flexible valves each associated with, and sealingly disposed over, a different one of said discharge openings, each said valve having an initially closed dispensing orifice which opens in response to a differential between the pressure acting against the side of the closed valve facing toward the associated discharge opening and the pressure acting against the side of the closed valve facing away from the associated discharge opening;

a closure body mounted to said container over said discharge opening and valves;

said closure body including a retaining deck defining at least two flow passages each aligned with a different one of said discharge passages and sealingly engaging a peripheral portion of each of said valves; and a top mounted by threaded engagement on said closure body for movement between an elevated position and a lowered position, said top defining at least one interior dispensing flow path from said closure body and at least one dispensing aperture that is in communication with said interior dispensing flow path to accommodate the dispensing of a fluent product from said system, said top defining an occlusion member that (a) cooperates with said closure body when said top is in said lowered position to occlude said interior dispensing flow path and prevent product from being dispensed from said system, and (b) opens said interior dispensing flow path when said top is moved away from said lowered position to permit the dispensing of a fluent product.

9. The system in accordance with claim 8 further including a flexible, peel-away seal strip releasably self-adhering to said top to seal closed said at least one aperture in said top.

10. The system in accordance with claim 8 in which said closure body includes an abutment member; and said top includes an engaging member shaped to engage said abutment member and prevent movement of said top beyond a predetermine elevated position on said closure body.

11. The system in accordance with claim 10 in which said abutment member and said engaging member are shaped to slide against each other when said top is initially screwed onto said closure body and said top and closure body are sufficiently flexible to accommodate movement of said engaging member past said abutment member when said top is initially screwed onto said closure body to locate said top at said lowered position.

12. The system in accordance with claim 8 in which each said valve is a separate article.

13. The system in accordance with claim 8 in which a single piece of elastomeric material includes each of said valves molded as unitary portions of said single piece of elastomeric material.

* * * * *